US008448561B2

(12) United States Patent
Carroll, III et al.

(10) Patent No.: US 8,448,561 B2
(45) Date of Patent: May 28, 2013

(54) WEAPON MOUNT

(75) Inventors: Alf L. Carroll, III, Marion, MA (US); Donald L. Chaloupka, Bristol, RI (US); Katherine E. Hoffman, Portsmouth, RI (US); Nathaniel J. Ward, Warwick, RI (US)

(73) Assignee: Raytheon Company, Waltham, MA (US)

( * ) Notice: Subject to any disclaimer, the term of this patent is extended or adjusted under 35 U.S.C. 154(b) by 741 days.

(21) Appl. No.: 11/894,464

(22) Filed: Aug. 21, 2007

(65) Prior Publication Data

US 2008/0202326 A1 Aug. 28, 2008

Related U.S. Application Data

(63) Continuation-in-part of application No. 11/657,907, filed on Jan. 25, 2007, now abandoned.

(60) Provisional application No. 60/839,951, filed on Aug. 24, 2006, provisional application No. 60/839,951, filed on Aug. 24, 2006.

(51) Int. Cl.
*F41A 23/00* (2006.01)

(52) U.S. Cl.
USPC ..... 89/38; 89/37.03; 89/37.12; 248/125.8; 248/129; 248/168; 248/177.1

(58) Field of Classification Search
USPC ..... 89/37.01, 37.02, 37.04, 37.06, 37.12, 89/37.13, 37.16, 37.17, 38; 248/125.8, 129, 248/168, 177.1, 298.1; 42/94
See application file for complete search history.

(56) References Cited

U.S. PATENT DOCUMENTS

| | | | | | |
|---|---|---|---|---|---|
| 473,939 | A | | 3/1892 | Mason | |
| 1,200,215 | A | | 10/1916 | Mixsell et al. | |
| 1,223,085 | A | | 4/1917 | Manierre | |
| 1,569,014 | A | | 1/1926 | Haubroe | |
| 2,176,215 | A | * | 10/1939 | Falge | 356/121 |
| 2,291,999 | A | * | 8/1942 | Wilson et al. | 248/656 |
| 3,138,994 | A | | 6/1964 | Blunk | |
| 3,438,305 | A | | 4/1969 | Nollet | |
| 4,175,783 | A | * | 11/1979 | Pioth | 296/20 |
| 4,434,703 | A | | 3/1984 | Fog et al. | |
| 4,465,069 | A | * | 8/1984 | Barbier et al. | 606/130 |
| 4,580,483 | A | | 4/1986 | Garbini | |
| 4,667,565 | A | | 5/1987 | Anderson | |
| 5,272,776 | A | * | 12/1993 | Kitamura | 5/601 |
| 5,353,680 | A | | 10/1994 | Tiomkin | |
| 5,590,429 | A | * | 1/1997 | Boomgaarden et al. | 5/600 |
| 5,625,159 | A | | 4/1997 | Malolepsy et al. | |
| 5,703,318 | A | * | 12/1997 | Franchino et al. | 89/37.07 |
| 6,009,791 | A | * | 1/2000 | Medlin | 89/38 |
| 6,250,196 | B1 | | 6/2001 | Sanderson | |
| 6,283,428 | B1 | | 9/2001 | Maples | |
| 6,286,411 | B1 | | 9/2001 | Sanderson | |
| 6,459,923 | B1 | * | 10/2002 | Plewes et al. | 600/411 |
| 6,546,662 | B1 | | 4/2003 | Chong | |

(Continued)

*Primary Examiner* — Daniel J Troy
(74) *Attorney, Agent, or Firm* — Schwegman Lundberg & Woessner, P.A.

(57) ABSTRACT

A mount system including a tray mountable to a port and a table translatable with respect to the tray. A mounting station is positioned on the table. There is a telescoping support for the tray. A drive mechanism translates the table to alternately conceal the mounting station within the port and to deploy the mounting station through the port.

15 Claims, 19 Drawing Sheets

U.S. PATENT DOCUMENTS

| | | | | |
|---|---|---|---|---|
| 6,564,690 | B1 | 5/2003 | Long | |
| 6,616,097 | B2 | 9/2003 | Hilbert | |
| 6,802,238 | B1 | 10/2004 | Sanderson | |
| 6,877,266 | B1 | 4/2005 | Brownlee | |
| 6,885,332 | B2 | 4/2005 | Panek et al. | |
| 6,973,689 | B2 * | 12/2005 | Lenting et al. | 5/601 |
| D515,168 | S | 2/2006 | Ruhland et al. | |
| 7,047,863 | B2 | 5/2006 | Hawkes et al. | |
| 7,048,238 | B2 * | 5/2006 | Rotondi | 248/125.8 |
| 7,100,880 | B2 | 9/2006 | Oddsen, Jr. | |
| 7,188,445 | B2 | 3/2007 | Lehman | |
| 7,210,391 | B2 | 5/2007 | Beckmann | |
| 7,258,055 | B1 | 8/2007 | Javorsky | |
| 7,415,790 | B1 | 8/2008 | Ruhland et al. | |
| 2004/0237372 | A1 | 12/2004 | Frye | |
| 2008/0047420 | A1 | 2/2008 | Carroll et al. | |
| 2008/0047421 | A1 | 2/2008 | Carroll, III et al. | |
| 2008/0060545 | A1 * | 3/2008 | Barbara | 105/443 |
| 2008/0173218 | A1 * | 7/2008 | Wang et al. | 108/20 |
| 2008/0202326 | A1 | 8/2008 | Carroll et al. | |

* cited by examiner

WEAPON MOUNT

RELATED APPLICATIONS AND PRIORITY CLAIM

This application is a continuation-in-part application of application Ser. No. 11/657,907 filed Jan. 25, 2007, now abandoned which claims the benefit of U.S. Provisional application No. 60/839,951, filed Aug. 24, 2006, and which is incorporated herein by reference. This application also claims the benefit of and priority to U.S. Provisional application No. 60/839,951, filed Aug. 24, 2006.

FIELD OF THE INVENTION

This subject invention relates to mounting systems for lethal engagement systems, non-lethal devices, and sensor systems.

BACKGROUND OF THE INVENTION

A large weapon such as a 50 caliber machine gun is often mounted in a weapon mounting station on a tripod. An example of a weapon mounting station is a remote operated small arms mount (ROSAM). Moving such a large and heavy weapon from a concealed position within a port (a window, for example) to a deployed position through the port would be difficult. The tripod would have to be repositioned from a location distant from the port to a location proximate the port. Given that a 50 caliber machine gun mounted to a ROSAM style weapon mounting station can weigh in excess of 450 lbs, the repositioning effort between a concealed and deployed position would be cumbersome and time consuming. And, even after the weapon is repositioned so the barrel of the weapon is now outside the port, its spatial coverage may be limited.

There is often a need to keep a weapon concealed and/or protected until its use is required. In but one example, it is desirable that any weapons associated with a non-military application is not viewable from public spaces. The idea is a non-threatening posture while maintaining protective capability. In another example, it is desirable that certain weapons on military applications be kept both protected and concealed until needed. Often, the mere act of deploying a concealed weapon is sufficient to prevent an act of violence. Known weapon mounts do not lend themselves to concealment and then rapid and easy deployment.

SUMMARY OF THE INVENTION

It is therefore an object of this invention to provide a new more versatile weapon mount.

It is a further object of this invention to provide such a weapon mount which deploys the weapon easily and quickly.

It is a further object of this invention to provide such a weapon mount which increases the coverage of the weapon.

It is a further object of this invention to provide such a weapon mount which is fairly simple in design and is easy to use.

It is a further object of this invention to provide such a weapon mount which can include an existing weapon station such as a ROSAM.

It is a further object of this invention to provide such a weapon mount which is stable and adequately supports the weapon in both the concealed mode and the deployed mode and while firing.

It is a further object of this invention to provide such a weapon mount which can be set up in different locations and without adversely affecting the port to which it is being deployed from.

It is a further object of this invention to provide such a weapon mount which can be easily tailored for different installations.

It is a further object of this invention to provide such a weapon mount which is reliable even in corrosive and rugged environments.

It is a further object of this invention to provide such a weapon mount which meets dynamic loading and support accuracy requirements.

It is a further object of this invention to provide such a weapon mount which can be engineered to deploy automatically especially in cases where sensors are used to detect potential threats.

It is a further object of this invention to provide such a weapon mount which is fully automated in order to ensure safety of personnel and also more efficient/direct reaction time.

The subject invention results from the realization that a versatile weapon mount which deploys a situation dependant weapon easily and quickly and which provides full weapon coverage in a stable manner is effected by a tray mountable to a port and supported by telescoping and rotatable support in combination with a table translatable with respect to the tray to alternately conceal the weapon within the port to provide protection and/or a non-threatening posture and which then deploys the weapon through the port thus maintaining protective capability.

The subject invention, however, in other embodiments, need not achieve all these objectives and the claims hereof should not be limited to structures or methods capable of achieving these objectives.

The subject invention features a mount system with a tray mountable to a port and a table translatable with respect to the tray. The mounting station is mounted to the table. There is a telescoping support for the tray. A drive mechanism translates the table to alternately conceal the mounting station within the port and to deploy the mounting station through the port.

In one example the tray includes at least one rail and the table rides on the rail. There may be a pair of spaced rails and the table may include shoes which engage the rails. One drive mechanism includes a threaded rod extending along the tray. The underside of the table includes a nut engaging the threaded rod. This mount system includes, but is not limited to, a handle for rotating the threaded rod. The mounting station may include a remote operated small arms mount.

The telescoping support may include a rotatable section. In one example, the tray is slideable with respect to the rotating section. The telescoping support may include a wheeled base. A rail subsystem may also be included for the wheeled base.

There is typically at least one bracket for mounting the tray to a sill of the port. There is also typically a locking mechanism for fixing the table with respect to the tray in the deployed position. One locking mechanism includes a pin in the table releasably received in a channel in the tray. There may also be a universal mount between the mounting station and the table. One universal mount includes a post and a pin and the table then includes a receiver socket for the post and a slot for the pin.

One mount system in accordance with the subject invention includes a tray mountable to a port and including at least one rail, a table mounted to translate along the rail, a mounting station on the table, a telescoping/rotating support for the tray, a bracket for mounting the tray to a sill of the port, a drive mechanism for translating the table along the rail to alternately conceal the mounting station within the port and to deploy the mounting station through the port, and a locking mechanism for releasably locking the table with respect to the tray.

A mount system in accordance with this invention may include a telescoping support with a moveable base and a rotatable section. A mounting station is carried by the telescoping support and is alternately concealed within a port and deployed through the port. There may be a tray on the telescoping support. A table is translatable with respect to the tray. The mounting station is positioned on the table. The mount system may further include a rail subsystem for the moveable base. The tray typically translates with respect to the rotatable section.

A mount system comprising a moveable base, a telescoping sections on the base including at least one rotatable section, a tray pivotably attached to a telescoping section and translatable with respect thereto, a table translatable with respect to the tray, and a mount rotatably positioned on the table.

BRIEF DESCRIPTION OF THE SEVERAL VIEWS OF THE DRAWINGS

Other objects, features and advantages will occur to those skilled in the art from the following description of a preferred embodiment and the accompanying drawings, in which.

DETAILED DESCRIPTION OF THE INVENTION

Figure 1:
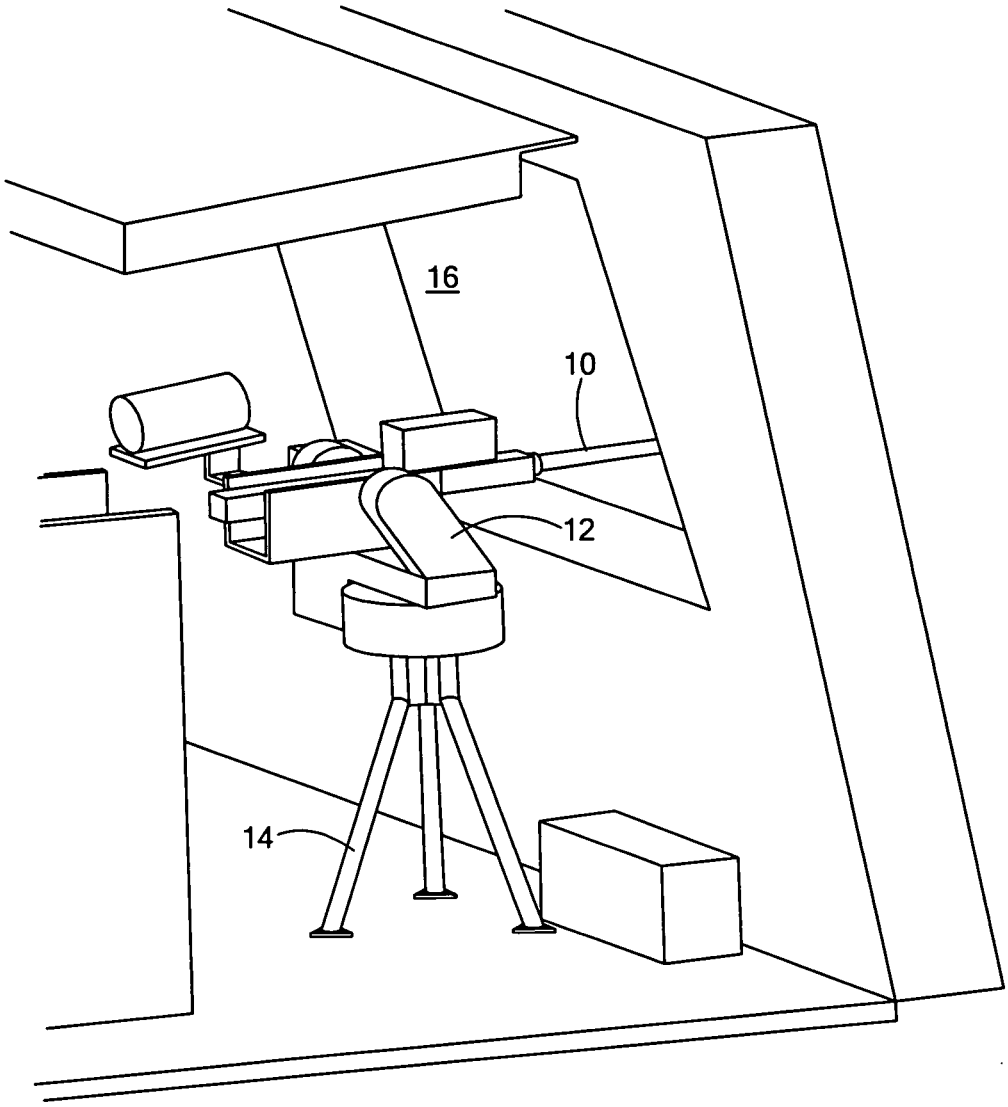
FIG. 1 (PRIOR ART)
FIG. 1 is a schematic three-dimensional view showing a typical prior art weapon mount.

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings. If only one embodiment is described herein, the claims hereof are not to be limited to that embodiment. Moreover, the claims hereof are not to be read restrictively unless there is clear and convincing evidence manifesting a certain exclusion, restriction, or disclaimer.

FIG. 1 shows 50 caliber weapon 10 within weapon mounting station 12 supported by tripod 14 in accordance with the prior art. Tripod 14 positions weapon 10 with respect to port 16. Port 16 may be, but is not limited to, a window in an embassy, a cruise whip, or a naval or coast guard vessel.

Figure 2:
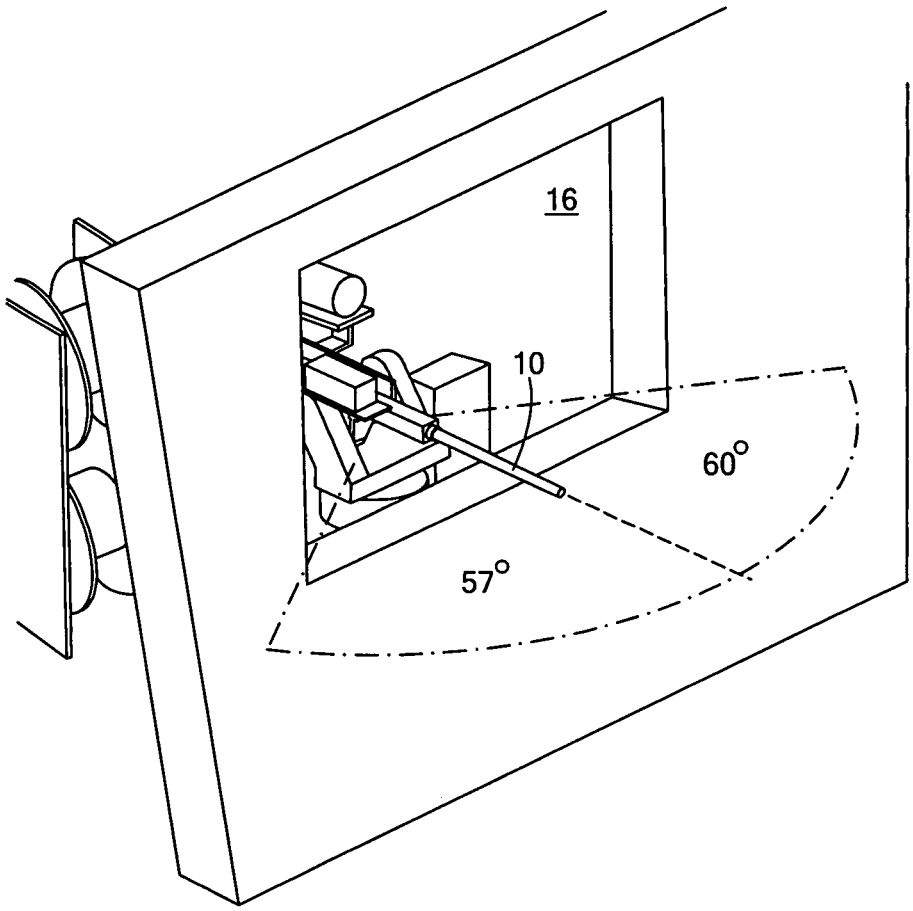
FIG. 2 (PRIOR ART)
FIG. 2 is a schematic three-dimensional view showing the limited spatial coverage associated with the prior art weapon mount shown in FIG. 1.

As described in the Background section above, it is difficult to provide a non-threatening posture while maintaining protective capability in accordance with such prior art weapon mounting systems. Tripod 14 is not easily or quickly moved. Often, tripod 14 is bolted to the deck of the ship. Typically, tripod 14 is not positioned sufficiently rearwardly of port 16 to completely conceal and/or protect weapon 10 and weapon mounting station 12. Even were tripod 14 brought as close as possible to port 16 and weapon 10 deployed as shown in FIG. 2, coverage is limited to a total yaw angle of 117°. Any repositioning effort of tripod 14 would be cumbersome and time consuming.

Figure 3:
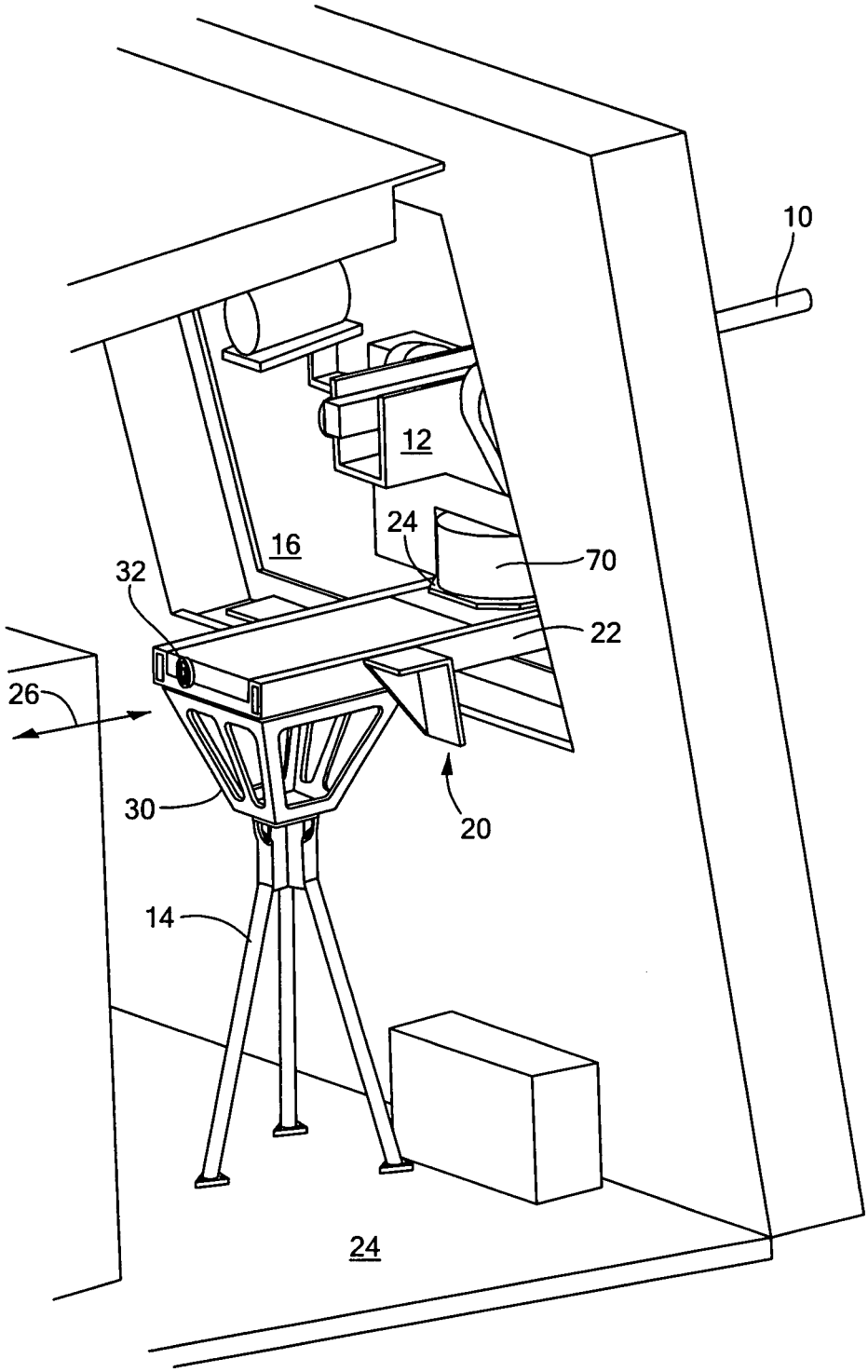
FIG. 3 is a schematic three-dimensional view showing, in one example, the primary components associated with a weapon mount in accordance with the subject invention.
Figure 4:
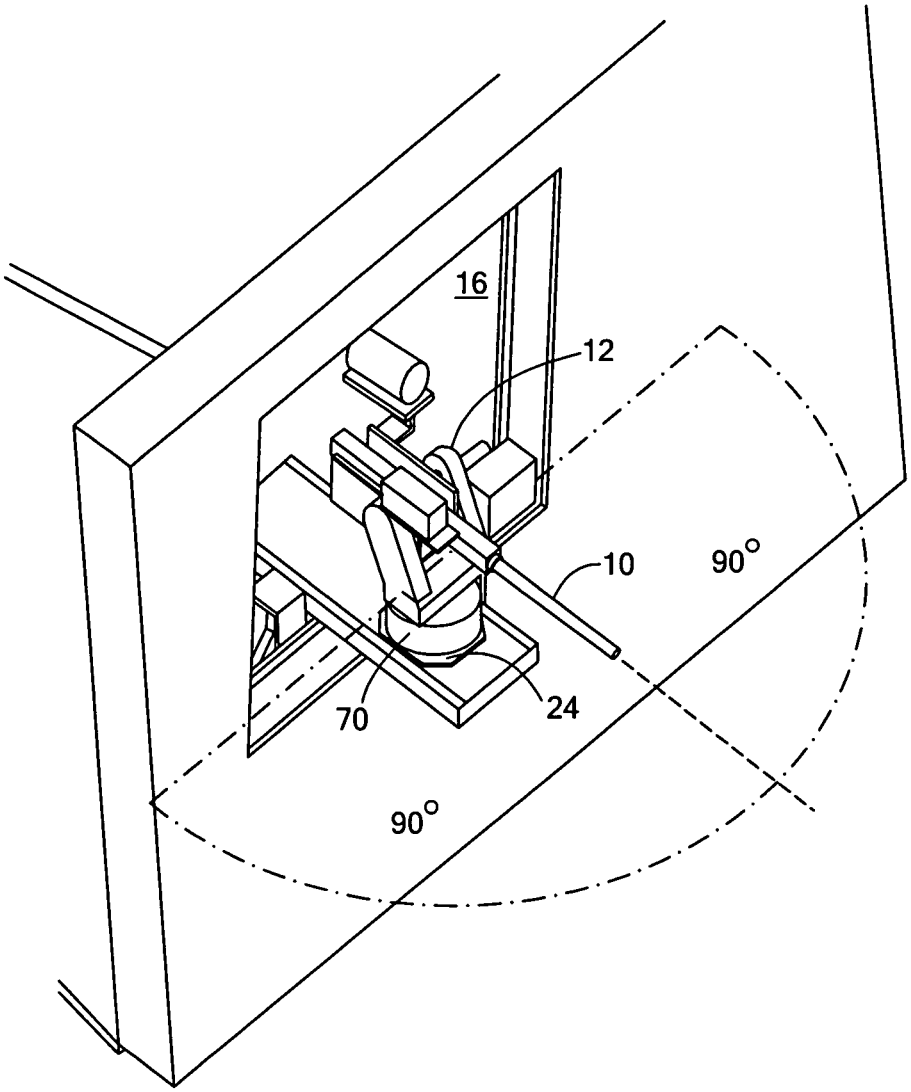
FIG. 4 is a schematic three-dimensional view showing the increased spatial coverage provided by the weapon mount of in FIG. 3.

In one example, the new weapon mount 20, FIG. 3 of the subject invention preferably includes tray 22 mountable with respect to port 16. Table 24 is translatable within tray 22 in the direction shown by arrow 26. Tray 22 is supported on deck or floor 24 preferably by prior art tripod 14 and new spacer bracket structure 30. A drive mechanism including drive wheel 32 translates table 24 to conceal weapon mounting station 12 mounted to table 24 within the port to provide a non-threatening posture. When desired, however, weapon 10 and weapon mounting station 12 are deployed through port 16 by turning drive wheel 32 either manually or automatically which drives table 24 forward. When concealment, protection, and/or servicing of weapon 10 is then desired, drive wheel 32 is turned in the opposite direction to drive table 24 rearwardly. In the deployed position shown in FIG. 4, weapon 10 coverage includes a total yaw angle of 180°.

Figure 6:
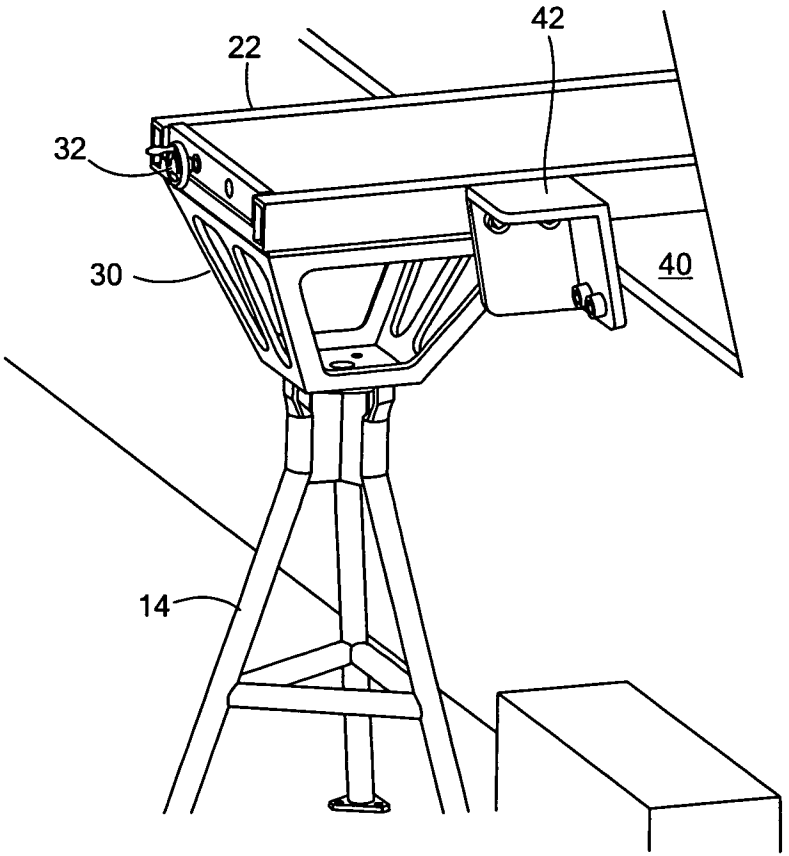
FIG. 6 is a schematic three-dimensional partial view of the weapon mount shown in FIG. 3 including brackets for mounting the tray thereof to the sill of the port.
Figure 5:
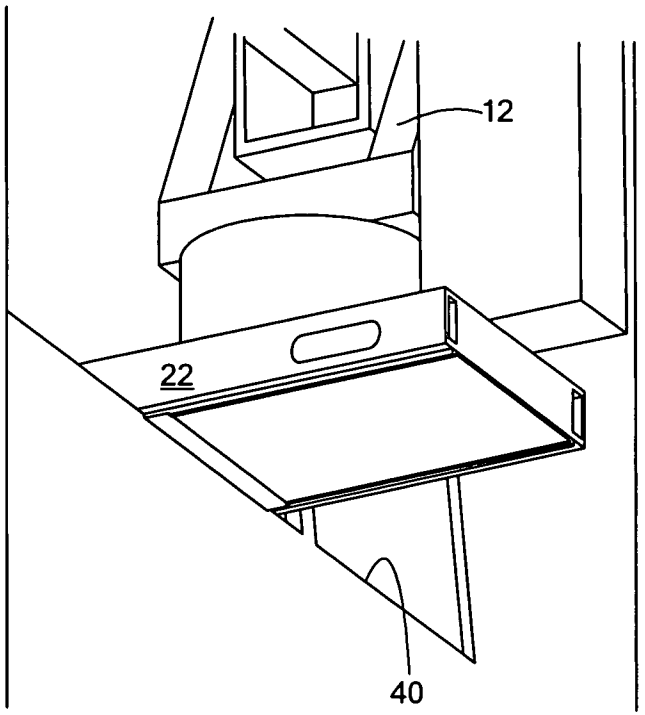
FIG. 5 is a schematic three-dimensional partial view showing the tray of the weapon mount shown in FIG. 3 supported on the sill of a port.
Figure 7:
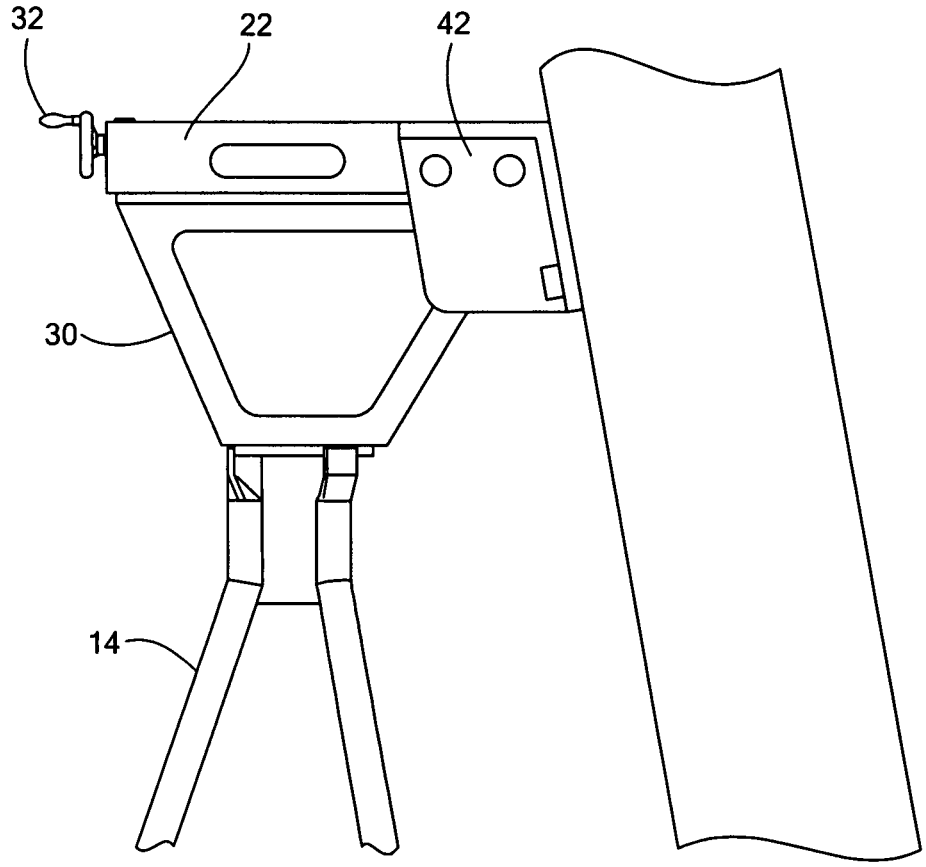
FIG. 7 is a schematic side view showing the bracket of FIG. 6.
Figure 8:
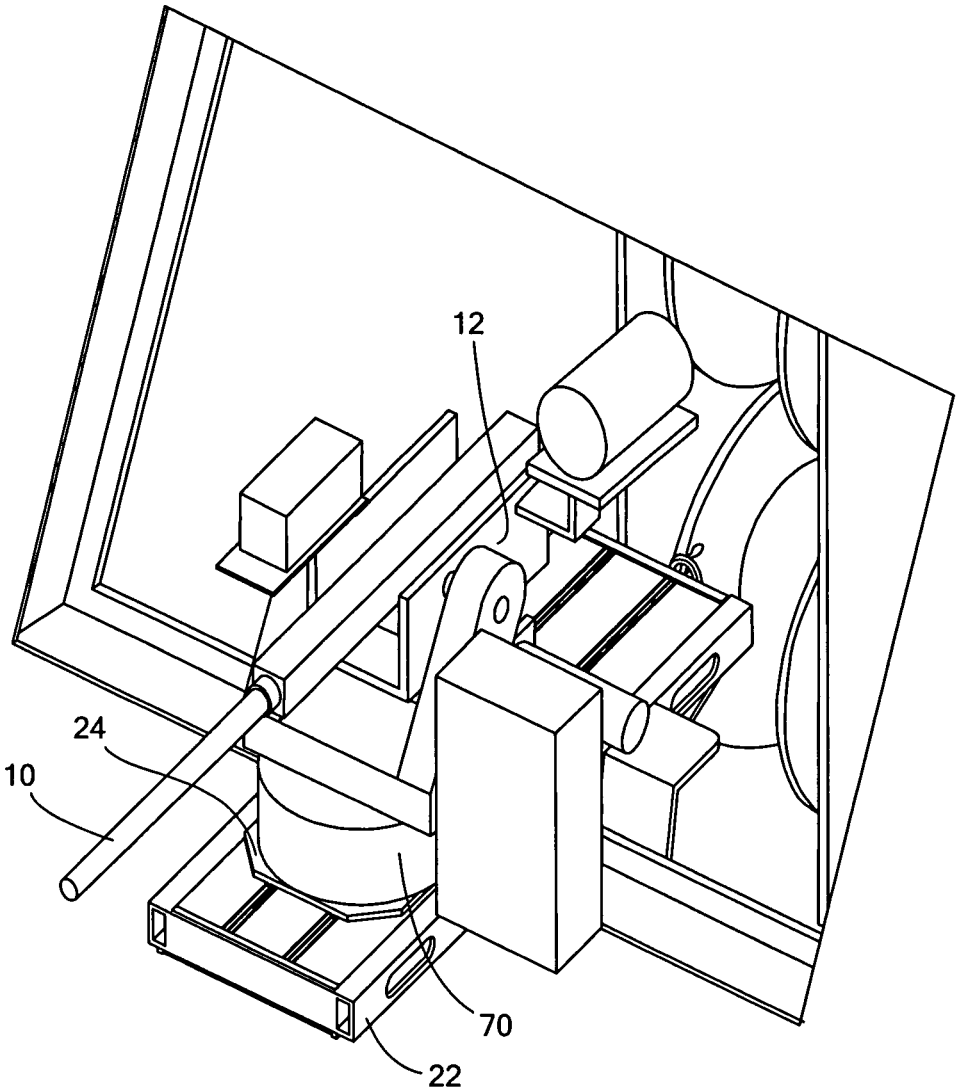
FIG. 8 is a schematic three-dimensional isometric view of the weapon mount shown in FIG. 3.
Figure 9:
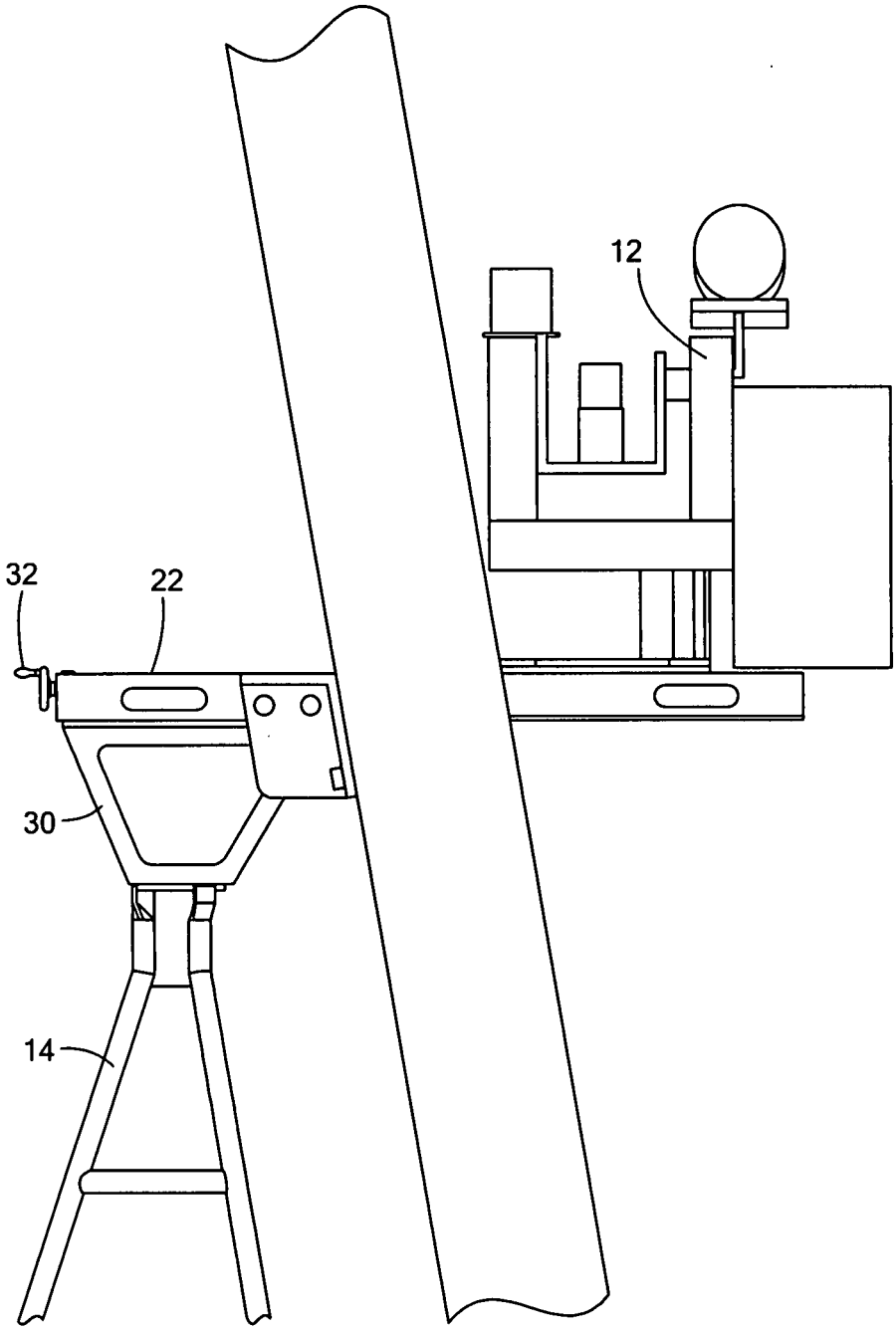
FIG. 9 is a schematic three-dimensional side view of the weapon mount shown in FIG. 3 with the weapon aimed 90° with respect to the port.
Figure 10:
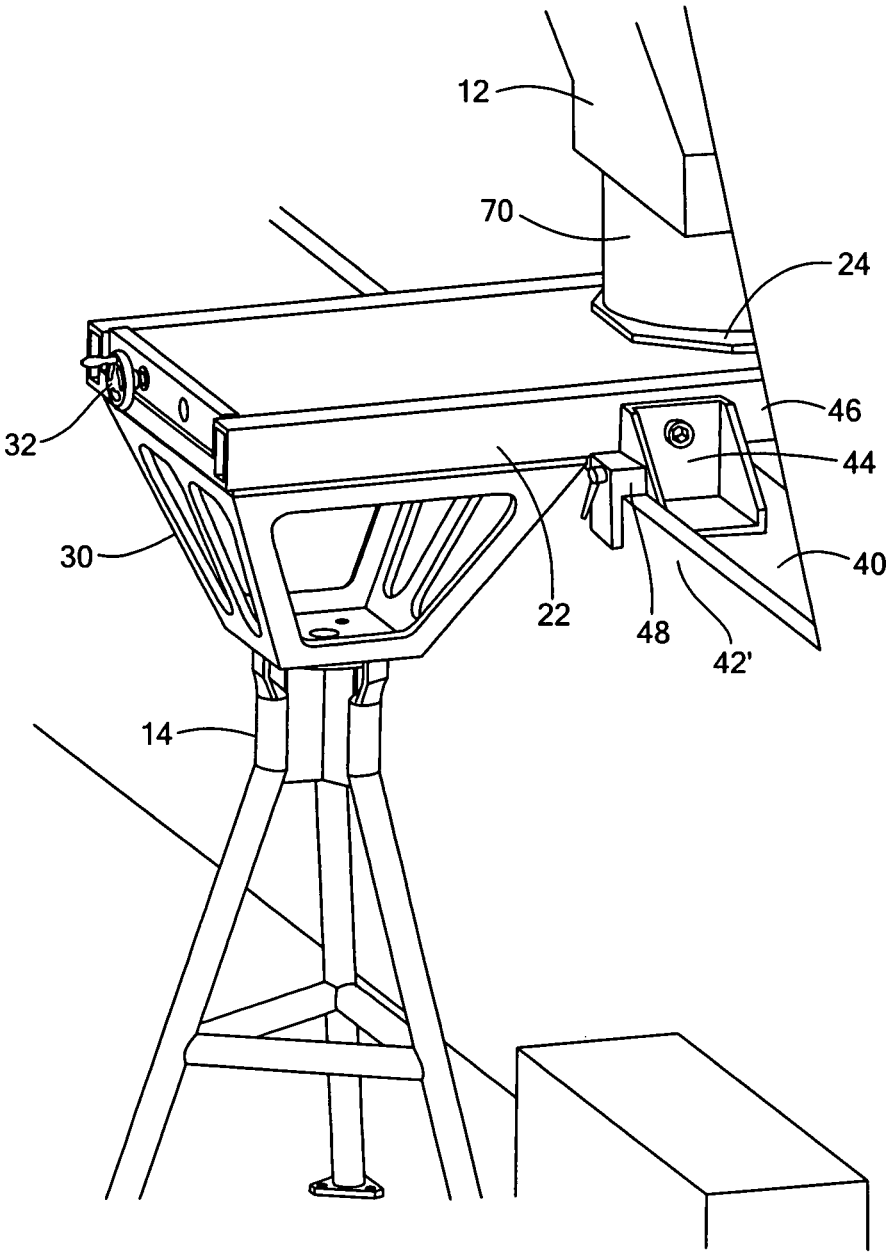
FIG. 10 is a schematic three-dimensional view of the weapon mount shown in FIG. 3 with an alternative configuration of a sill bracket.

As shown in FIGS. 5-10, tray 22 typically rests on sill 40 of the port and bracket 42, FIG. 6 may be used to fix tray 22 in place on sill 40. An alternative bracket design is shown at 42' in FIG. 10. Bracket portion 44 is fixed to tray side rail 46 and bracket portion 48 clamps bracket portion 44 to sill 40. By driving table 24 fully forward as shown in FIG. 9, weapon mounting station 12 is fully outside of the port for 180° yaw angle weapon coverage.

The result in any embodiment is a more versatile weapon mount which deploys a weapon easily and quickly and in a way such that the coverage of the weapon is increased. The weapon mount is relatively simple in design and easy to use. Existing components like tripod 14, FIG. 3 and a ROSAM style weapon station mount 12 can be fully utilized reducing the cost of the system. The weapon mount is stable and adequately supports the weapon in both the concealed mode and in the deployed mode while firing. The weapon mount can be set up in different locations and typically without adversely affecting the port to which it is mounted. By adjusting in configuration and dimensions of spacer structure 30, FIG. 6, the weapon mount can be easily tailored for different installations (e.g., ports or windows of different heights and configurations). The weapon mount is reliable even in corrosive and rugged environments and adequately meets dynamic loading and support accuracy requirements. Bracket portion 42', FIG. 10 can be padded on the bottom with heavy duty rubber to minimize sill damage. Bracket portion 42' reduces torsion that tripod 14 would otherwise have to absorb. The preferred embodiment of spacer structure 30 is a weight optimized frame structure of welded construction as shown. The height of spacer structure 30 can be varied for different port configurations. Spacer structure 30 typically bolts to prior art tripod mount 14 and to tray 22.

A nylon slide allows the tray to be slid out the window and the rubber section drops into an installed position. Preferably, the natural frequency of the weapon mount is greater than 30 Hz to provide sufficient stiffness for vertical deflection and torsion.

Figure 11:
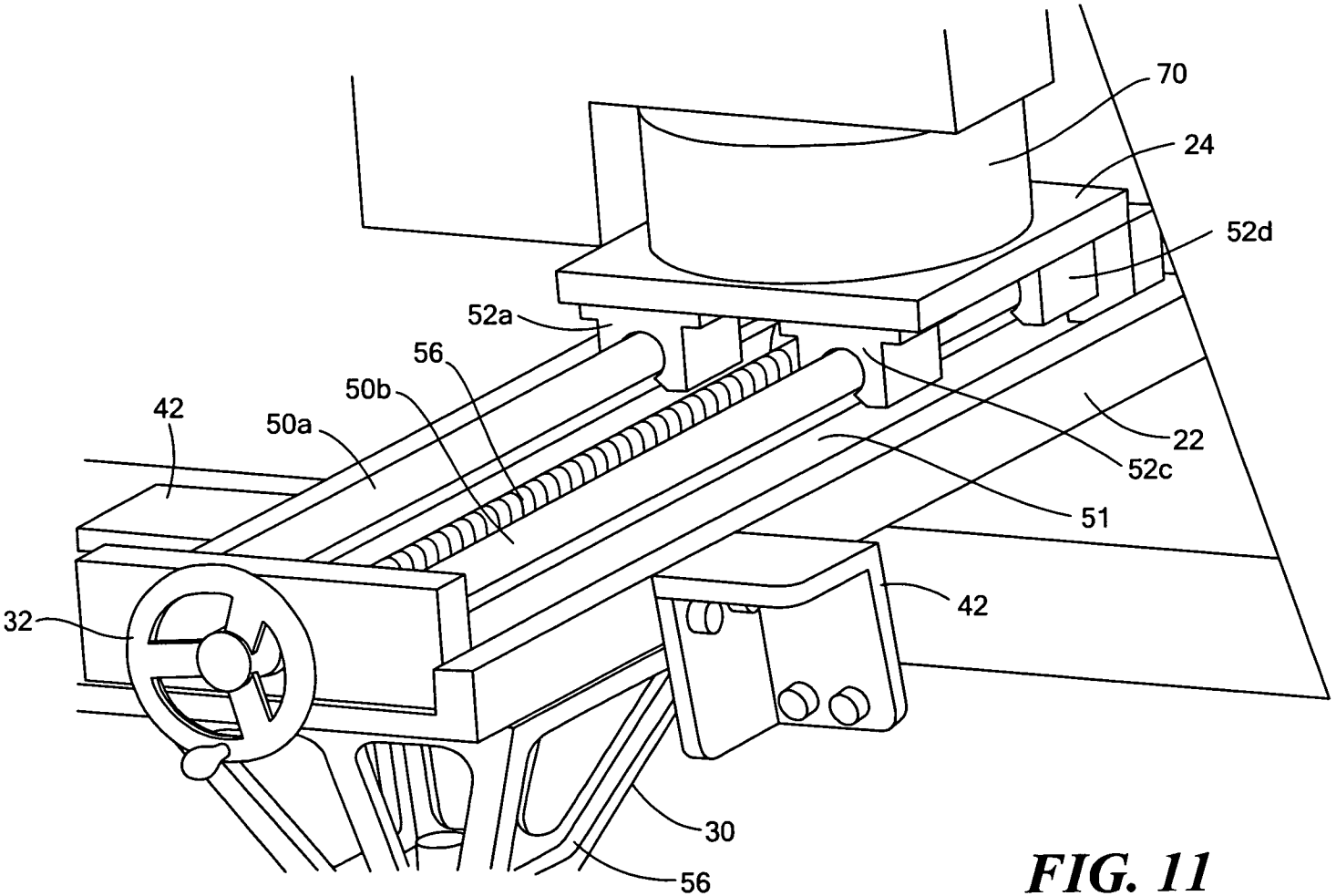
FIG. 11 is a schematic three-dimensional view showing one version of a drive mechanism for the weapon mount of the subject invention.
Figure 12:
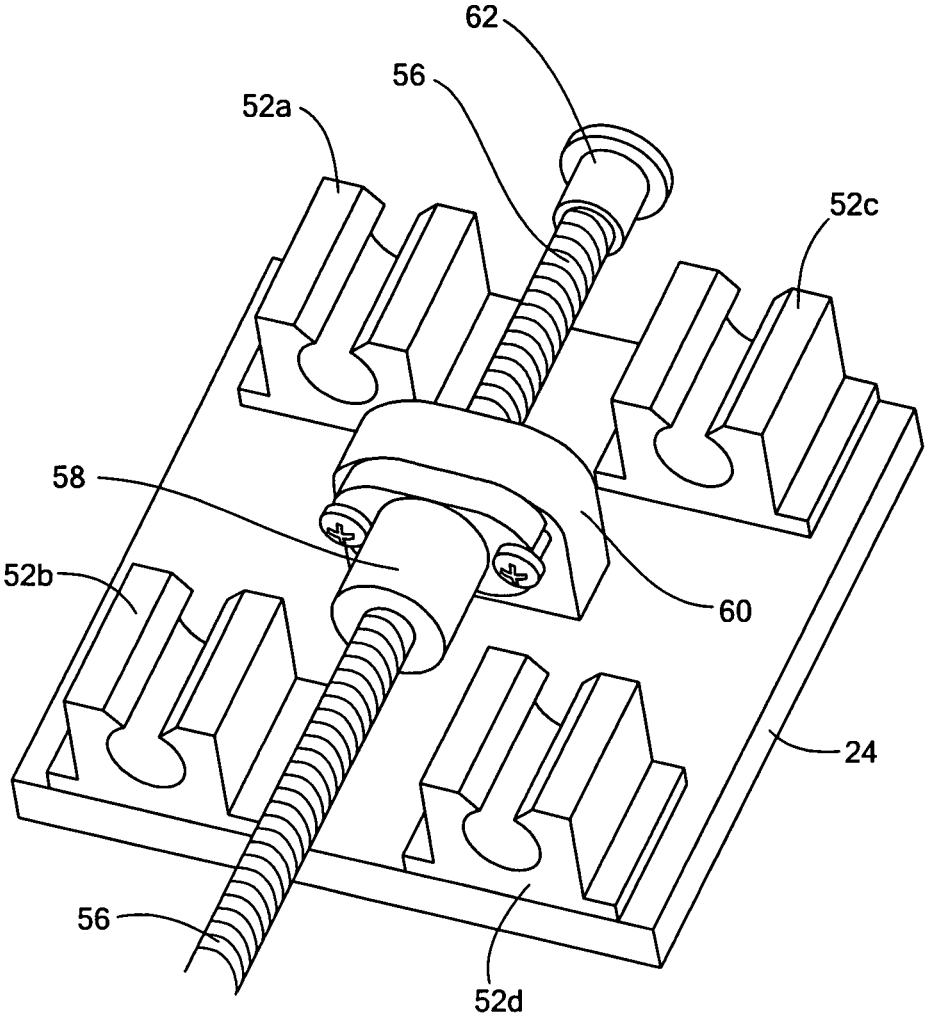
FIG. 12 is a schematic three-dimensional view showing the underside of the sliding table of the weapon mount shown in FIG. 11.

FIGS. 11-12 show an example of table 24 mounted to slide on rails 50*a* and 50*b* via shoes 52*a*-52*d* which ride on tray portion 51. Threaded rod 56 extends along tray portion 51 through nut 58 attached to ear 60 on the underside of table 24. Bushing 62 defines the limit of travel of table 24. Handle 32 connects to and is used to rotate rod 56 and thus translate table 24. Or, threaded rod 56 may be driven by a motor.

Figure 13:
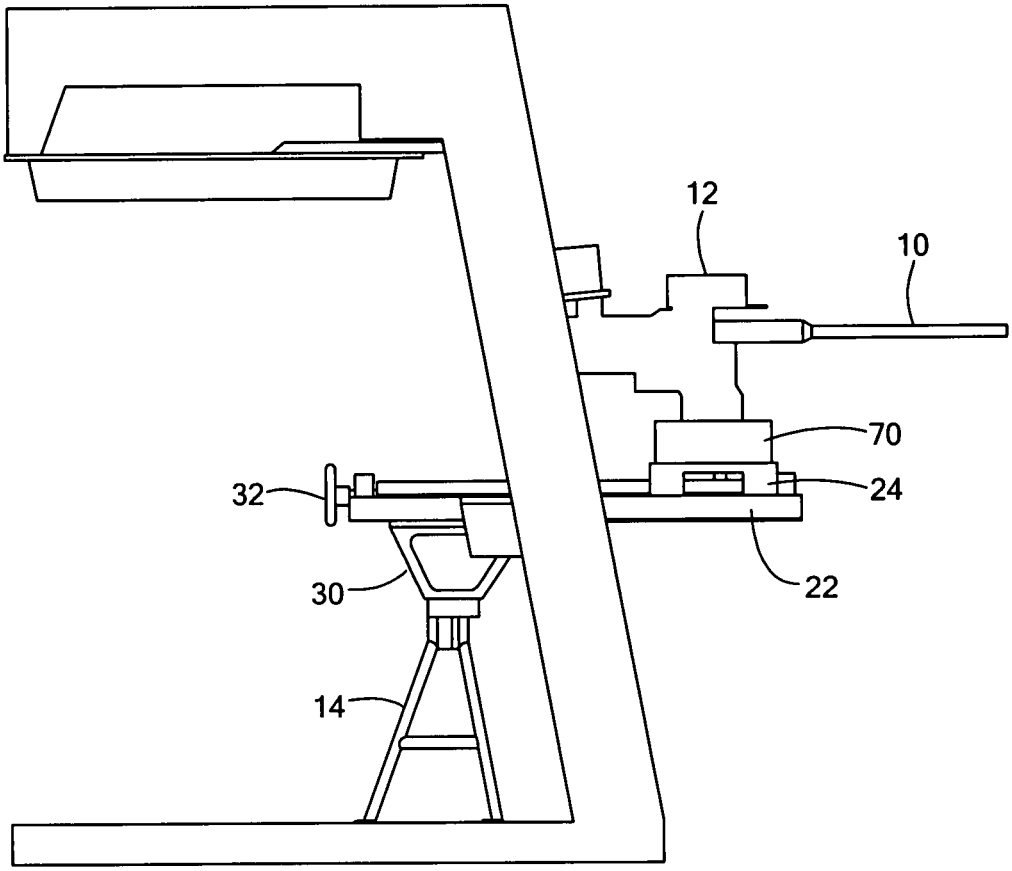
FIG. 13 is a schematic three-dimensional view showing the location of a universal mount of a weapon mount in accordance with the subject invention.
Figure 14:
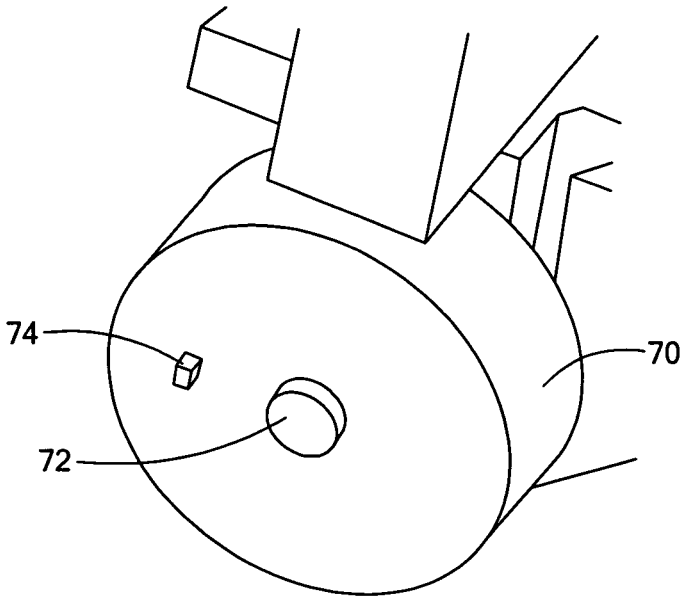
FIG. 14 is a schematic three-dimensional front view showing the universal mount of FIG. 13.
Figure 15:
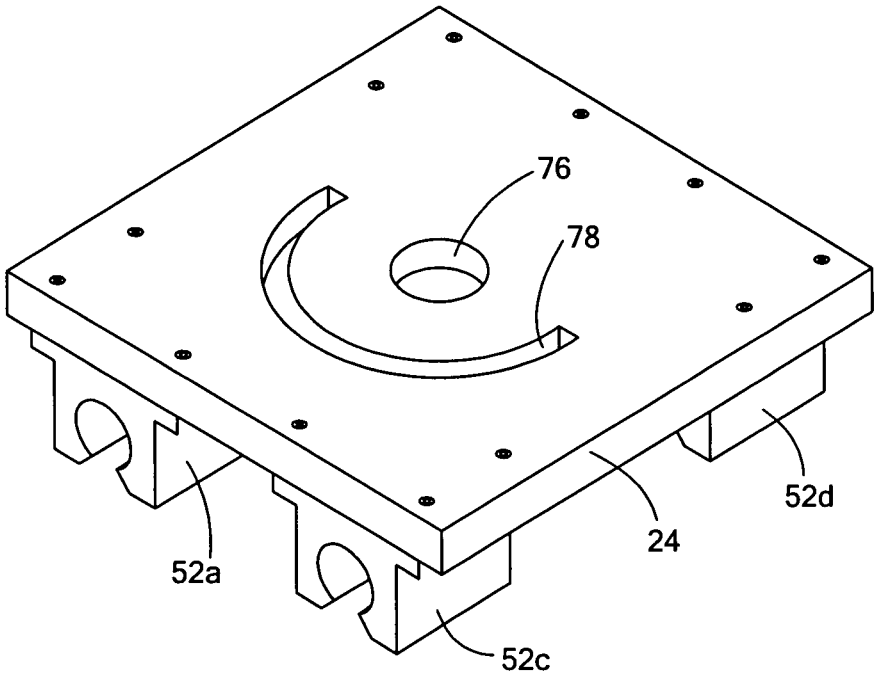
FIG. 15 is a schematic three-dimensional top view of the sliding table shown in FIGS. 11-13.

For a mounting station 12 such as a remote operated small arms mount (a "mini-typhoon" available from General Dynamics and Rafael, for example), universal mount 70, FIGS. 13-14 may be provided. Universal mount 70, FIG. 14 includes central post 72 and pin 74. The top of table 24, FIG. 15, in turn, includes central receiver socket 76 for universal mount post 72, FIG. 14 and arcuate slot 78, FIG. 15 for pin 74, FIG. 14. This allows universal mount 70 to rotate with respect to sliding table 24 to the limits defined by arcuate slot 78.

Figure 16:
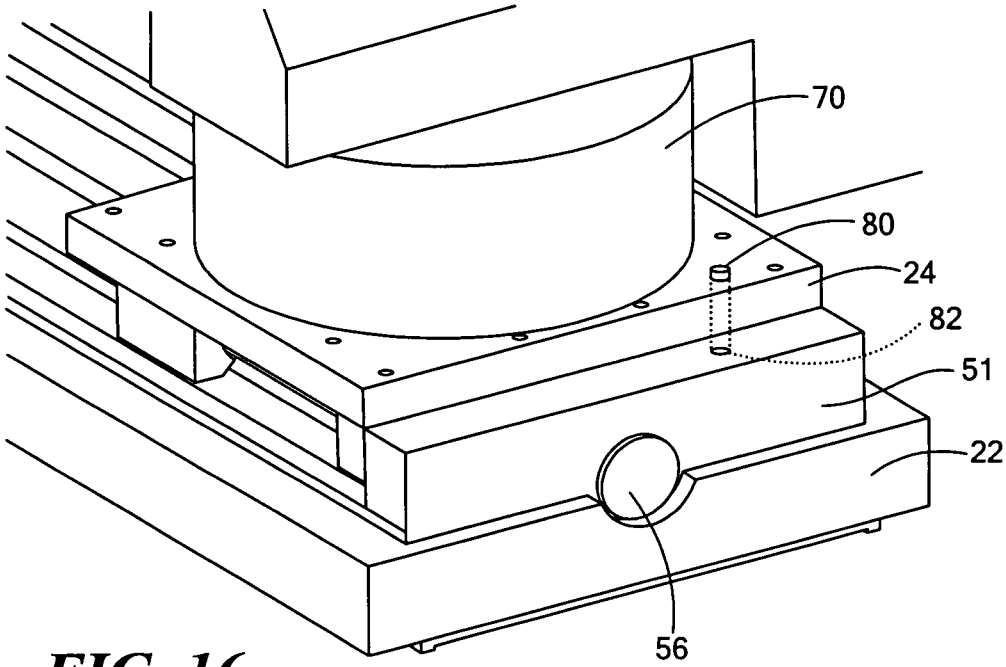
FIG. 16 is a schematic three-dimensional end view showing an example of a mechanism for locking the sliding table shown in FIG. 15 to the weapon mount tray.
Figure 17:
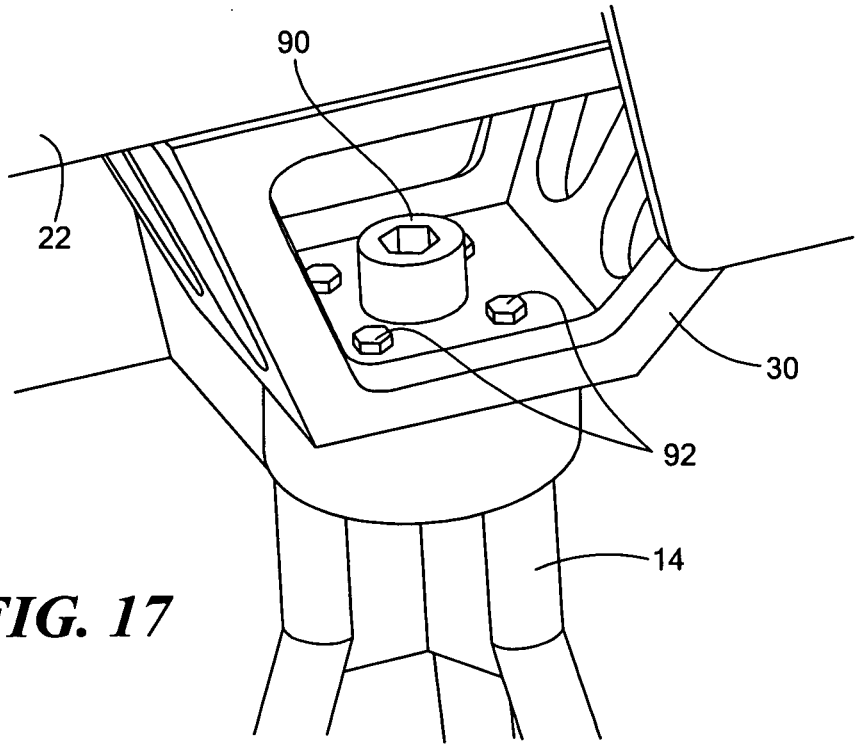
FIG. 17 is a schematic three-dimensional partial view of a weapon mount in accordance with the subject invention showing how the bracket is connected to the tripod.

There may also be a locking mechanism for releasably fixing table 24, FIG. 16 with respect to tray portion 51 such as pin 80 in table 24 which can be manually pushed down into channel 82 in table portion 51. Pin 80 can also be motor driven, by a solenoid, for example (not shown) up and down to lock table 24 to tray portion 51. Tray portion 51 can be adhered to tray portion 22 itself glued to bracket 30, FIG. 17. Bracket 30 can be bolted to tripod 15 using socket head cap screw 90 and/or bolts 92. The legs of tripod 14 can be bolted to the deck of the installation.

All of the components of the weapon mount described above can be made of corrosion resistant metals, composite materials, or a combination of the same. Mounting station 12, FIGS. 8-9 can vary in design to include various gun mounts and also mounts for non-lethal weapons such as a long range acoustic device (e.g., the "LRAD 500", American Technology Corp.). Other sensors, warning devices, hailing devices, surveillance devices, and weapons are known to those skilled in the art. By strategically locating numerous such weapon mounts on a vessel, the vessel can be fully protected. In any installation, and in any embodiment, the mount of the subject invention, whether fitted with a weapon and/or a non-lethal device, easily and quickly provides deployment and better coverage in a stable manner. The table which is translatable with respect to the tray alternately can position the weapon or non-lethal device within the port provide protection and/or non-threatening posture and is enabled to deploy the weapon or non-lethal device through the port thus maintaining a protective capability.

Figure 18:
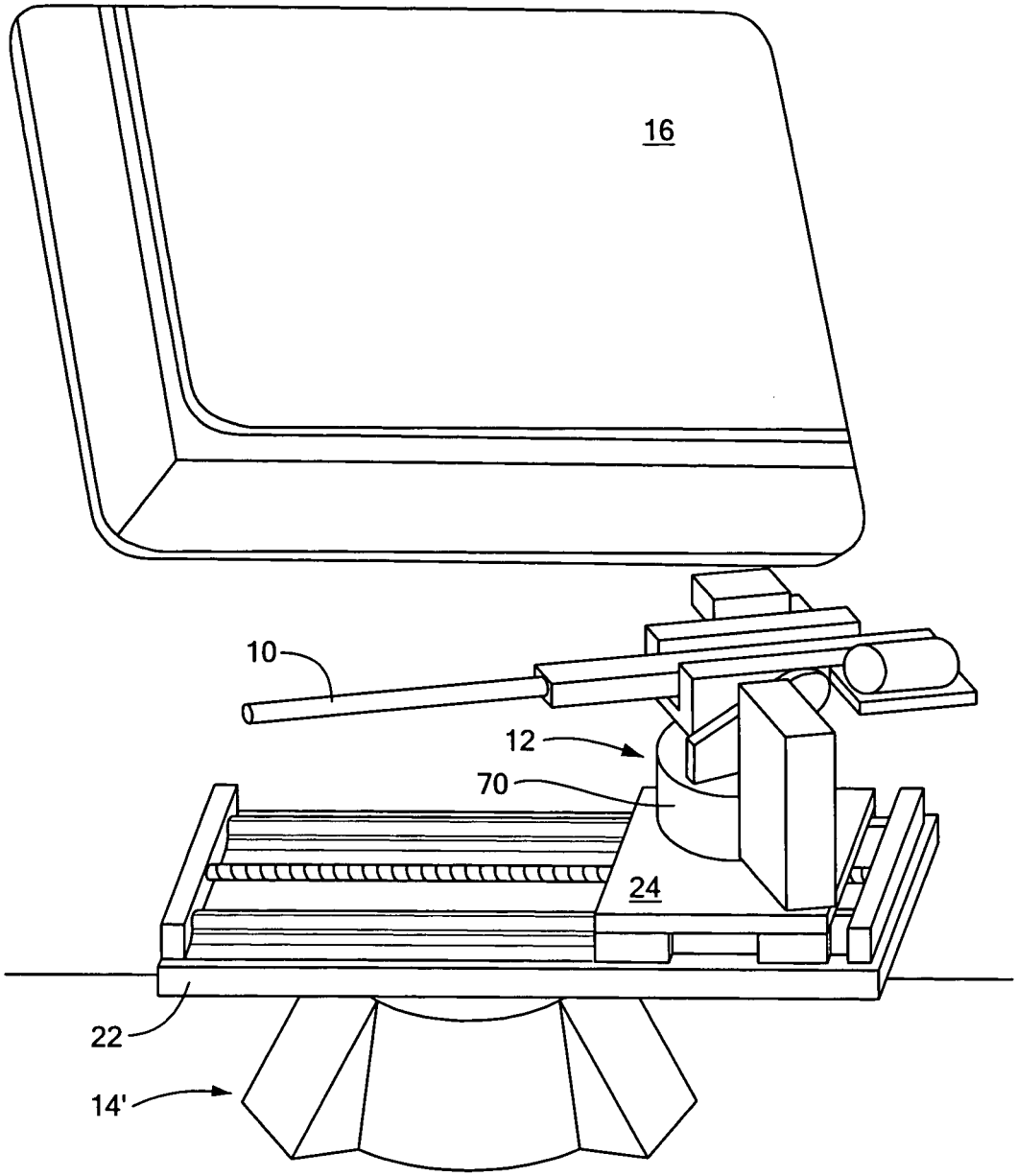
FIG. 18 is a schematic three-dimensional view of another example of a weapon mount in accordance with the subject invention showing the mount fully concealed 15, within a port.
Figure 19:
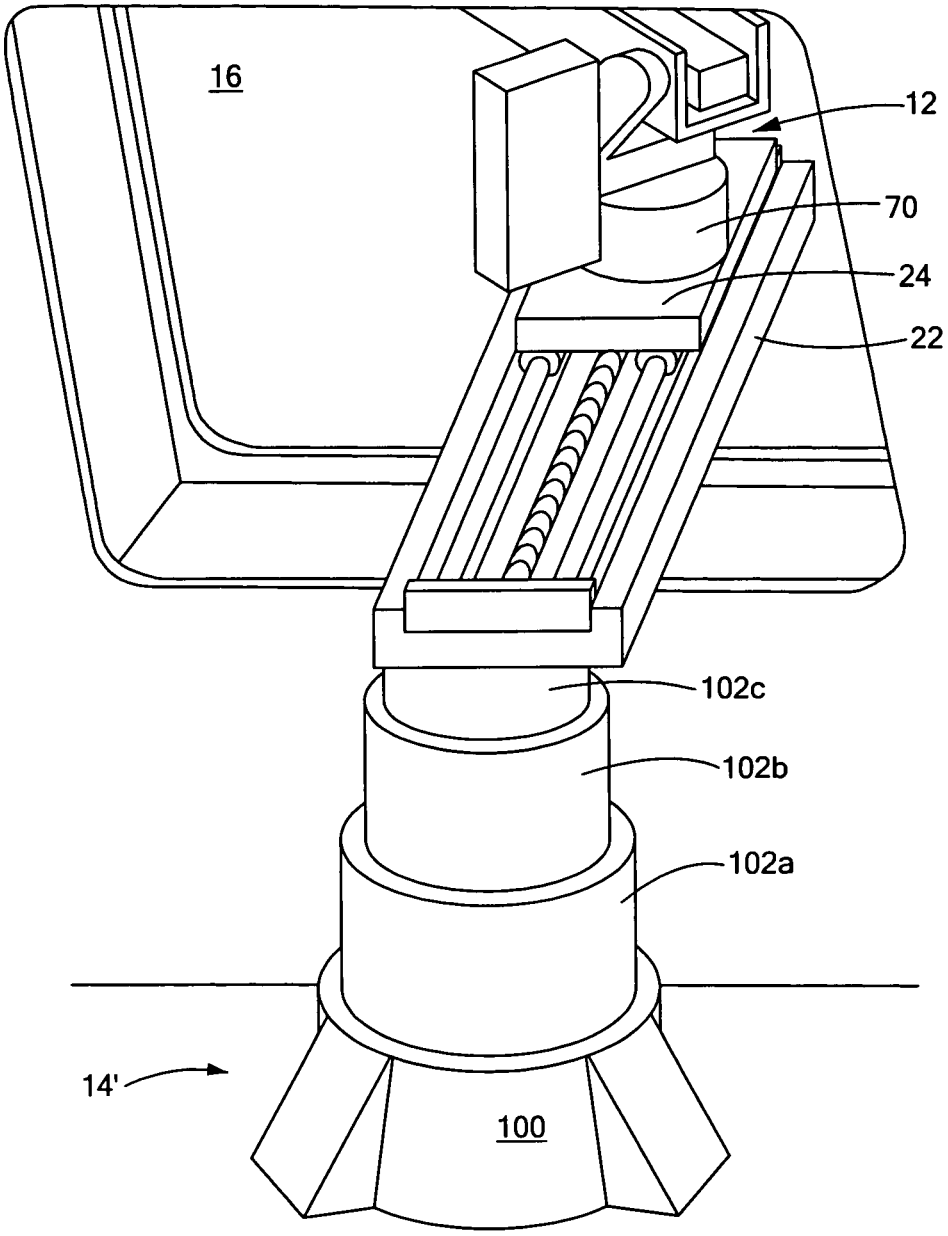
FIG. 19 is a schematic view of the weapon mount of FIG. 18 in its deployed position.

FIG. 18 shows another embodiment of a support 14' for mounting station 12 typically mounted on table 24 slideable on tray 22 as discussed above. As shown in FIG. 19, support 14' telescopes up and down and includes base 100. At least one of telescoping sections 102*a*, 102*b*, and 102*c* is rotatable to maneuver tray 22 from the position shown in FIG. 18 to the position shown in FIG. 19. Tray 22 also translates with respect to rotatable section 102*c*.

Figure 20:
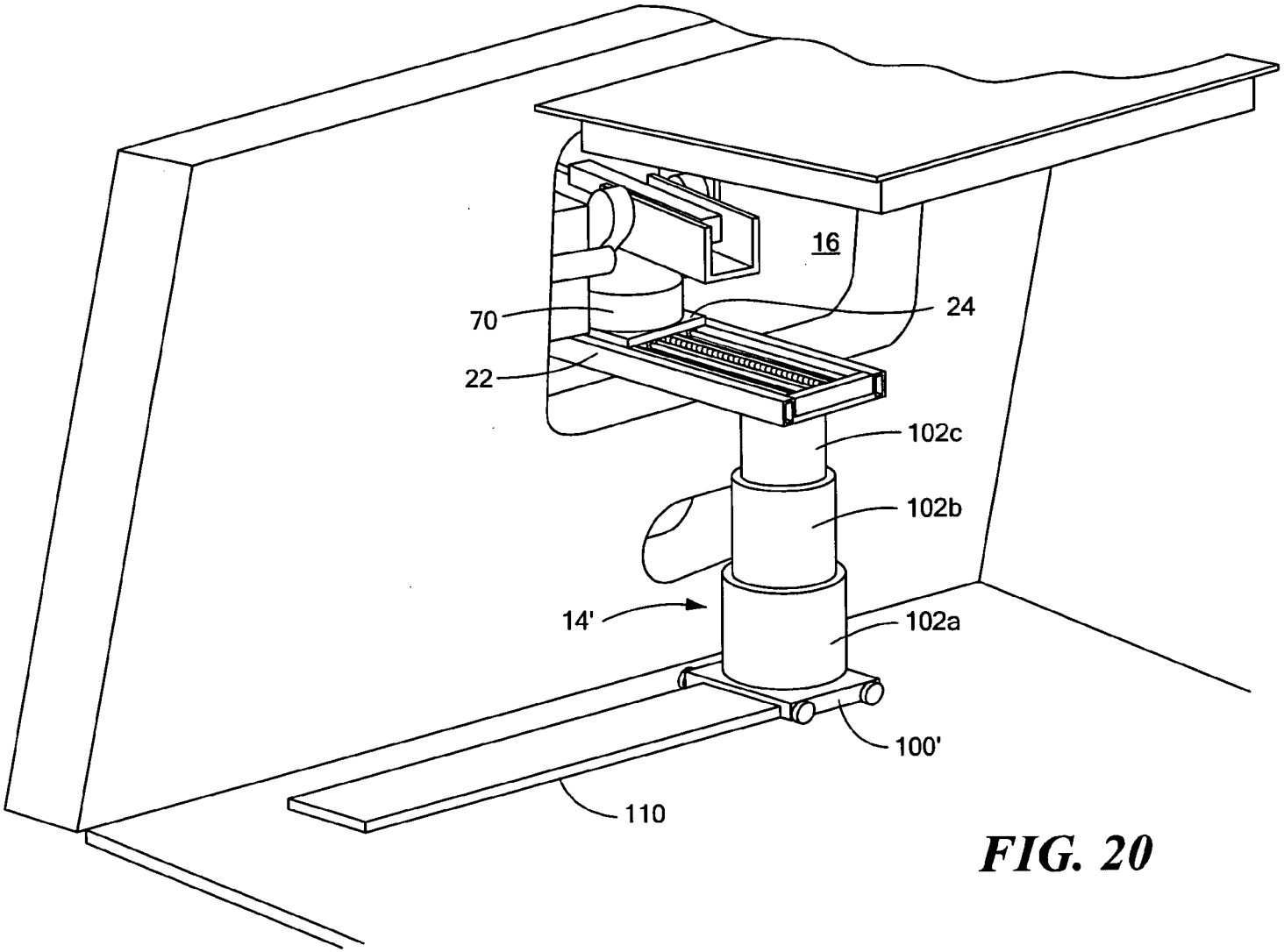
FIGS. 20-21 are three-dimensional schematic views showing a weapon mount in accordance with the subject invention with the mount deployed through a port.
Figure 21:
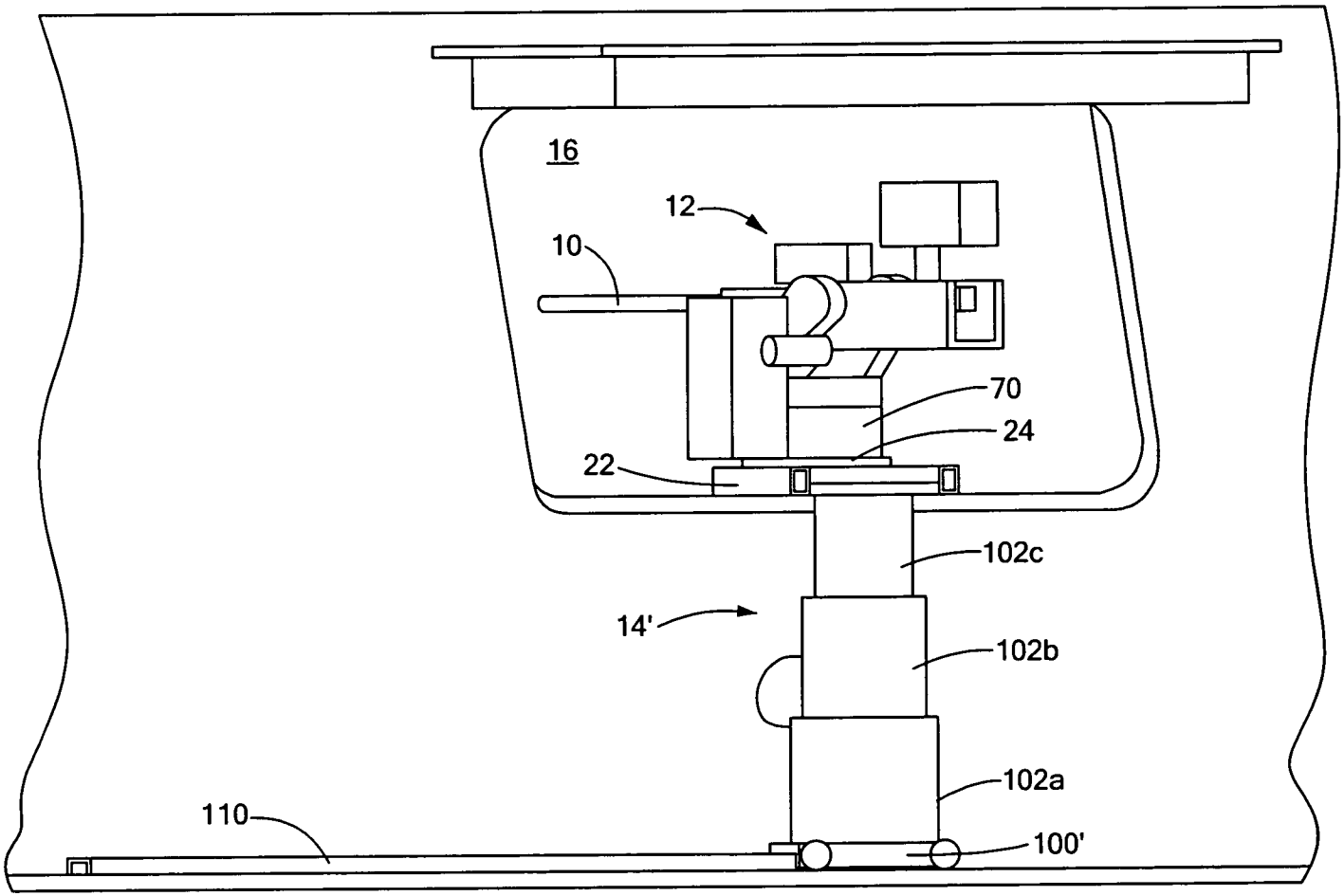

As shown in FIGS. 20-21, base 100' includes wheels and rail subsystem 110 is included for guiding wheeled base 100'. Base 100' thus translates linearly, telescoping support 14' extends up and down, and rotating section 102*c* allows tray 22 to pivot and translate linearly to alternately position mount 12 within port 16 (FIG. 18) and through port 16 (FIGS. 19-21) whereupon table 24 translates linearly with respect to tray 22 and mount 12 can rotate with respect to table 24.

The other features disclosed above with respect to FIGS. 3-17 are also possible as is the ability to lock base 100', FIG. 21 with respect to rails 110, lock rotatable section 102*c*, and lock tray 22 with respect to rotatable section 22.

Figure 22:
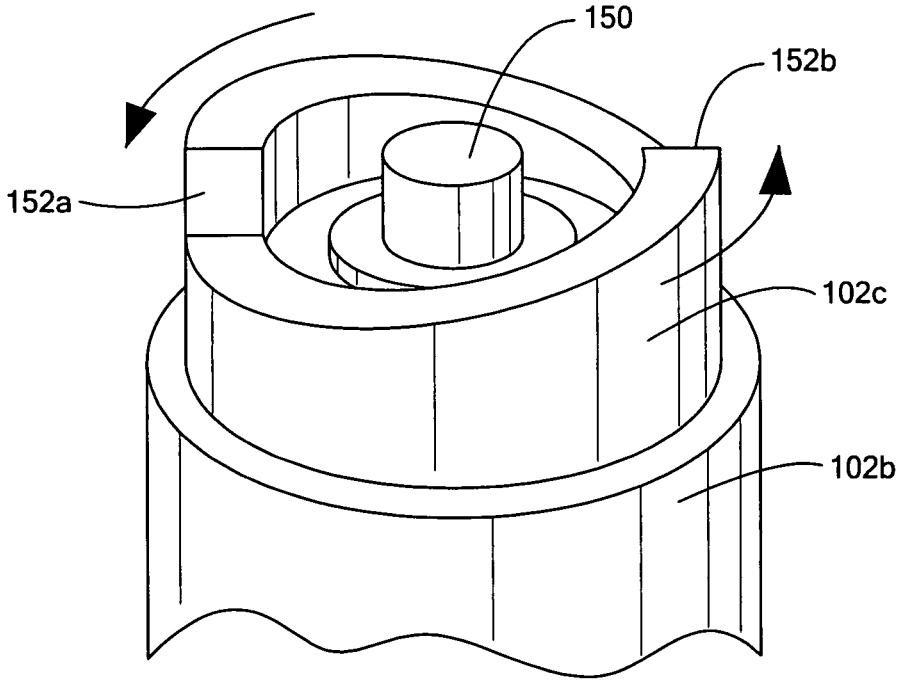
FIG. 22 is a schematic view of the rotary section of the weapon mount support.
Figure 23:
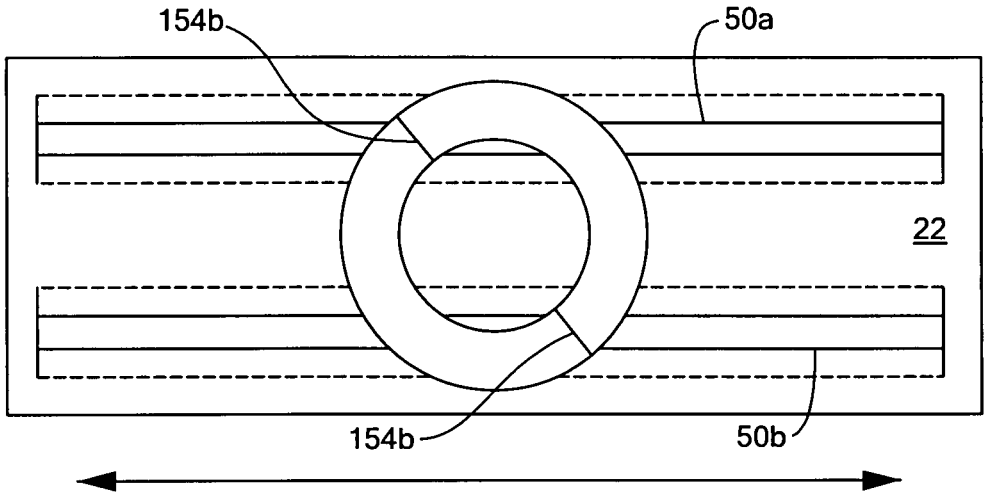
FIG. 23 is a plan view of the underside of the weapon mount tray.

As shown in FIG. 22, rotatable telescoping section 102 may include servo motor 150 which rotates section 102. Drive surfaces 152*a* and 152*b* of rotary section 102 engage similarly centrifugal driven surfaces 154*a* and 154*b* in the underside on tray 22. Thus, when motor 150, FIG. 22 is energized, rotating section 102*c* rotates and drives tray 22, FIG. 3 to rotate as well.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments. Other embodiments will occur to those skilled in the art and are within the following claims.

In addition, any amendment presented during the prosecution of the patent application for this patent is not a disclaimer of any claim element presented in the application as filed: those skilled in the art cannot reasonably be expected to draft a claim that would literally encompass all possible equivalents, many equivalents will be unforeseeable at the time of the amendment and are beyond a fair interpretation of what is to be surrendered (if anything), the rationale underlying the amendment may bear no more than a tangential relation to many equivalents, and/or there are many other reasons the applicant can not be expected to describe certain insubstantial substitutes for any claim element amended.

What is claimed is:

1. A mount system comprising:

a tray mountable to a port and configured to extend therethrough;

a table translatable with respect to the tray, said table including a receiver socket and an arcuate slot therein;

a mounting station positioned on the table, said mounting station configured to pass through said port when said table is translated;

a telescoping support for the tray;

a generally cylindrical mount between the mounting station and the table, said mount including a post for the receiver socket and a pin to be received by the arcuate table slot for rotating said mount with respect to the table; and a drive mechanism for translating the table to alternately conceal the mounting station within the port and to deploy the mounting station through the port.

2. The mount system of claim 1 in which the tray includes at least one rail and the table rides on the rail.

3. The mount system of claim 2 in which the tray includes a pair of spaced rails and the table includes shoes which engage the rails.

4. The mount system of claim 1 in which the drive mechanism includes a threaded rod extending along the tray and the table includes a nut engaging the threaded rod.

5. The mount system of claim 4 in which the nut is positioned on an underside of the table.

6. The mount system of claim 4 further including a handle for rotating the threaded rod.

7. The mount system of claim 1 in which the mounting station includes a remote operated small arms mount.

8. The mount system of claim 1 in which the telescoping support includes a rotatable section.

9. The mount system of claim 8 in which the tray translates with respect to the rotating section.

10. The mount system of claim 8 in which the telescoping support further includes a wheeled base.

11. The mount system of claim 10 further including a rail subsystem for the wheeled base.

12. The mount system of claim 1 further including at least one bracket for mounting the tray to a sill of the port.

13. The mount system of claim 1 further including a locking mechanism for fixing the table with respect to the tray in the deployed position.

14. The mount system of claim 13 in which the locking mechanism includes a pin in the table releasably received in a channel in the tray.

15. The mount system of claim 1 in which the mount is a universal mount.

* * * * *